United States Patent [19]

Sereda et al.

[11] 4,323,004

[45] Apr. 6, 1982

[54] INSTALLATION FOR PREPARING MULTICOMPONENT LIQUID MIXES IN PRODUCTION OF STRONG ALCOHOLIC LIQUORS

[76] Inventors: Alexandr I. Sereda, ulitsa Dzerzhinskogo, 34, kv. 8, Yalta Krymskoi oblasti; Ivan F. Nyagu, ulitsa Lenina, 39, kv. 33, Beltsy Moldavskoi SSR; Igor N. Smirnov, ulitsa Narodnogo opolchenia, 20, kv. 363, Moscow; Grigory I. Russu, ulitsa Lenina, 1, kv. 63; Izrail L. Yasinovsky, ulitsa Ostrovskogo, 46, kv. 12, both of Beltsy Moldavskoi SSR, all of U.S.S.R.

[21] Appl. No.: 155,608

[22] Filed: Jun. 2, 1980

[51] Int. Cl.[3] ..... B01F 15/04; B67D 5/08

[52] U.S. Cl. ..... 99/275; 137/93; 137/99; 366/161; 222/132

[58] Field of Search ..... 99/275, 276, 277, 277.1, 99/277.2, 278, 323.1, 323.2; 366/152, 161; 137/93, 99; 222/132, 63

[56] References Cited

U.S. PATENT DOCUMENTS

| | | | |
|---|---|---|---|
| 893,343 | 7/1908 | Meyer | 99/275 |
| 2,513,562 | 7/1950 | Holuba | 366/152 |
| 4,209,258 | 6/1980 | Oakes | 366/152 |
| 4,228,924 | 10/1980 | Gilbert | 137/99 |

*Primary Examiner*—Robert W. Jenkins

*Attorney, Agent, or Firm*—Steinberg & Raskin

[57] ABSTRACT

An installation for the preparation of multicomponent liquid mixes in the production of alcoholic liquors includes a plurality of feed tanks, a dispensing pump unit for feeding respective ones of the liquid components, a plurality of suction pipings each of which communicates between a respective feed tank and a respective dispensing pump of the dispensing unit, a header for collecting the liquid components, a plurality of delivery pipings each of which communicates between a respective dispensing pump and the header and a receiving tank adapted to receive the mixed liquid components. A throttling mixer is arranged substantially at the outlet of the header means and includes normally closed membrane valves which are provided with respective membrane actuators having above-membrane chambers. The above-membrane chambers of the membrane actuators communicate with the suction pipings and a common delivery pipe which itself communicates between the outlet of the throttling mixer and the receiving tank.

4 Claims, 3 Drawing Figures

INSTALLATION FOR PREPARING MULTICOMPONENT LIQUID MIXES IN PRODUCTION OF STRONG ALCOHOLIC LIQUORS

FIELD OF THE INVENTION

The present invention relates to installations for preparing multicomponent mixes and has particular reference to installations for preparing multicomponent mixes in production of strong alcoholic liquors.

The present invention can find application in those branches of industry which make use of said installation (i.e., chemical, petrochemical and food industries).

In particular, the invention is applicable to good advantage in the wine industry and in production of hard alcoholic liquors, such as grape brandies, fruit brandies, whisky, gin, rum, etc.).

BACKGROUND OF THE INVENTION

At the present time installations for preparing multicomponent mixes in the production of strong alcoholic liquors and refreshment beverages incorporate mixing tanks for blend components, provided with propeller stirrers and, less frequently, with immersible pumps. These installations, however, are labor intensive, feature high specific metal consumption, and involve considerable losses of the product during operation.

One prior-art installation for preparing multicomponent liquid mixes in production of strong alcoholic liquors is disclosed in USSR Inventor's Certificate No. 247,206, cl.C 12 g, 3/04, issued in 1969.

This known installation comprises pumps for feeding alcohol and softened water to a three-chamber blender, wherein the first chamber is used to obtain a coarse water-alcohol mix, the second chamber serves for bringing said mix to a required condition and additional stirring when correcting its alcohol content, while in the third chamber the resultant mix is seasoned.

Provision of the three chambers and a mandatory stirring of the mix in the second chamber results in losses of the product when carrying out the process of blending the components.

Another prior-art installation for preparing multicomponent mixes in production of refreshment beverages is disclosed in the catalogue of advertising prospectuses available from the Hauke Co., Austria, 1968.

This known installation comprises a number of feed tanks, a receiving tank, suction and delivery pipings, and a dispensing pump unit for delivering the component of a refreshment beverage.

The blend of the beverage being prepared is then saturated with carbon dioxide gas and agitated in a separate tank with the help of a propeller stirrer, whereupon the thus-prepared blend is forwarded for further technological treatment which involves some losses of the product. However, when said installation is made use of (without the process of saturation with carbon dioxide gas) for producing strong alcoholic liquors, said losses become more substantial due to the greater value of the stock products.

In addition, one more prior-art installation for preparing multicomponent mixes in the production strong alcoholic liquors (viz., rum) is known to be in current use (cf. the prospectus of the Lewa Co. published in Federal Republic of Germany in 1976, p. 11), which installation constitutes the starting point of the present invention.

This known installation comprises a number of feed tanks, a receptacle tank, a number of suction pipings, a delivery piping, a dispensing pump unit for delivering alcohols, sugar syrup, colouring agent, and other liquid blend components, a header, and pickups of the pressure, density and alcohol content of the resultant liquid mixture.

The installation incorporates a number of dispensing pumps and mixers, each of said pumps and mixers being followed by the product density pickups which complicates the installation as a whole. Moreover, with the dispensing pumps arranged according to the aforesaid process flowsheet, the pressure differential effective between the suction and delivery ends thereof is a function of the liquid level in the feed and receiving tanks. This might result in a spontaneous overflow of the liquids in the direction of the discharge end both with the pumps running and standing still, which affects the dispensing accuracy.

BRIEF DESCRIPTION OF THE INVENTION

It is a primary and essential object of the present invention to provide a constant pressure differential effective in the zone of intermixing of the original components and prevent these components from flowing via the flow-through passages of the pump unit at an excess suction pressure.

It is another object of the present invention to render the process more intensified.

it is one more object of the present invention to provide a higher accuracy of dispensing the original components.

It is still another object of the present invention to reduce the amount of lost product due to dispensing with an additional stirring of the product and a stage of transferring the latter.

According to said objects the present invention resides in that in an installation for preparing multicomponent liquid mixes in production of strong alcoholic liquors, comprising a number of feed tanks, a receiving tank, a number of suction pipings, a delivery piping, a dispensing pump unit for delivering alcohols, sugar syrup, colouring agent and other liquid blend components, a header and pickups to monitor the pressure, density and alcohol content of the resultant liquid mixture, according to the present invention built into the delivery piping is a throttling mixer, incorporating a number of normally-closed hydraulically operated membrane valves, each having a membrane actuator, whereas the above-membrane chambers of said actuators are communicated respectively with the suction pipings and the delivery piping.

It is due to such an arrangement of the above elements that the process can be intensified owing to the provision of a constant pressure differential effective in the zone of intermixing the original components and by preventing these from flowing via the flow-through passages of the pump unit.

In addition, the membrane valves of the throttling mixer are arranged in series, while the sliding elements of the membrane actuators are arranged in two mutually normal planes passing through the collector axis at an angle of from 60° to 90° thereto.

It is due to such an arrangement of the above elements that turbulization of the flows of the components being mixed is set up, thus dispensing with an additional stirring of the blend.

The above-membrane chamber of the valve actuator communicates, according to the present invention, with the pressure pickups in the suction pipings, while the above-membrane chamber of the other valve actuator is communicated with the pressure pickup in the delivery piping.

Such an interconnection of the elements provides for a constant pressure differential effective in the zone of intermixing of the blend components and thereby establishes identical conditions for their intermixing both at the beginning and the end of the process.

According to the invention the pickup of the alcohol content is situated on the header before the inlet of sugar syrup and colour agent thereto.

Due to this provision the output signal of the alcohol content pickup is prevented from being distorted.

Other objects and advantageous features of the present invention will become more evident from a consideration of the following exemplary illustrative embodiment thereof to be read in conjunction with the attached drawings, wherein.

DETAILED DESCRIPTION OF THE INVENTION

Figure 1:
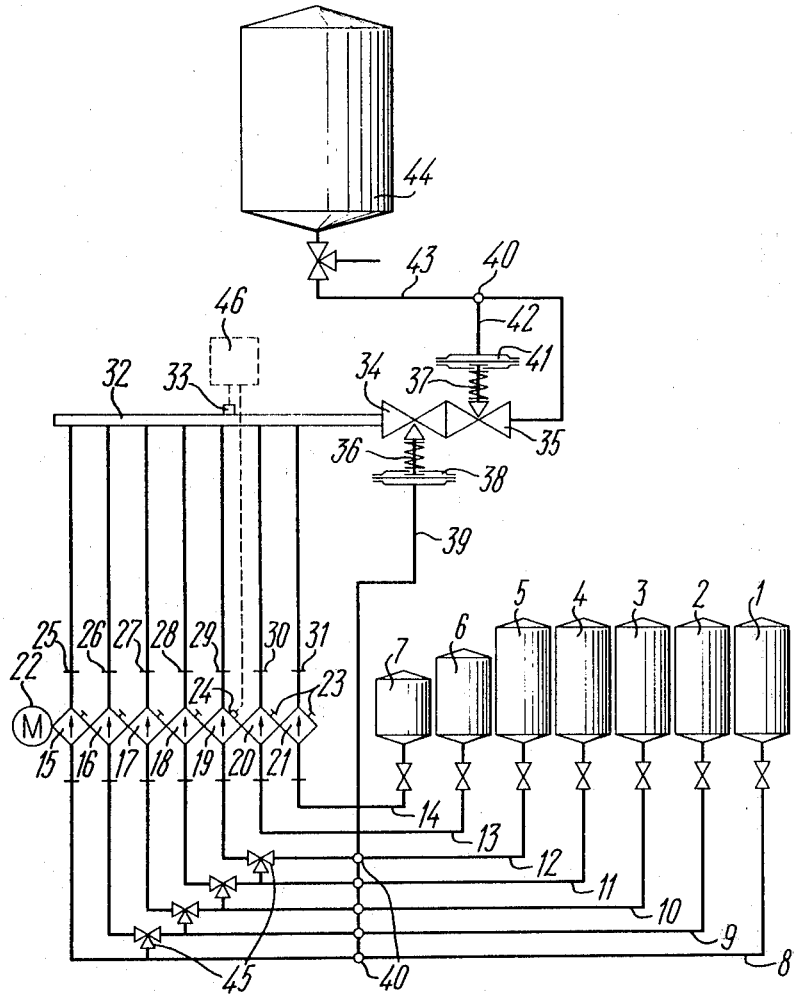
FIG. 1 is a general schematic diagram of the installation, according to the invention.

The installation for preparing multicomponent liquid mixes in production of strong alcoholic liquors represented in FIG. 1, comprises a feed tank 1 for alcoholized water, feed tanks 2, 3, 4 for alcohols, a feed tank 5 for softened water, a feed tank 6 for alcoholized sugar syrup, and a feed tank 7 for alcoholized colouring agent.

The feed tanks 1 through 7 are communicated through respective suction pipings 8,9,10,11,12,13 and 14 with the dispensing pumps for the blend components, viz., a pump 15 for alcoholized water, pumps 16, 17, 18 for alcohols, a pump 19 for softened water, a pump 20 for alcoholized sugar syrup and a pump 21 for alcoholized colouring agent. All of the pumps 15 through 21 are integrated into the dispensing assembly driven from an electric motor 22.

The motor 22 may be of any of the heretofore known electric motor constructions suitable for the purpose.

The dispensing pumps 15, 16, 17, 18, 20 and 21 have manually operated actuators 23 for controlling the rate of feed of the original components, whereas the pump 19 has a manual actuator and an electric operator 24.

Delivery nozzles 25, 26, 27, 28, 29, 30, 31 of the dispensing pumps are communicated with a header 32 which is provided with a pickup 33 monitoring the alcohol content of a mixture of components less sugar syrup and the colouring agent, said pickup being situated upstream of the places where the delivery nozzles 30, 31 of the pumps 20, 21 are connected to the header 32.

Figure 2:
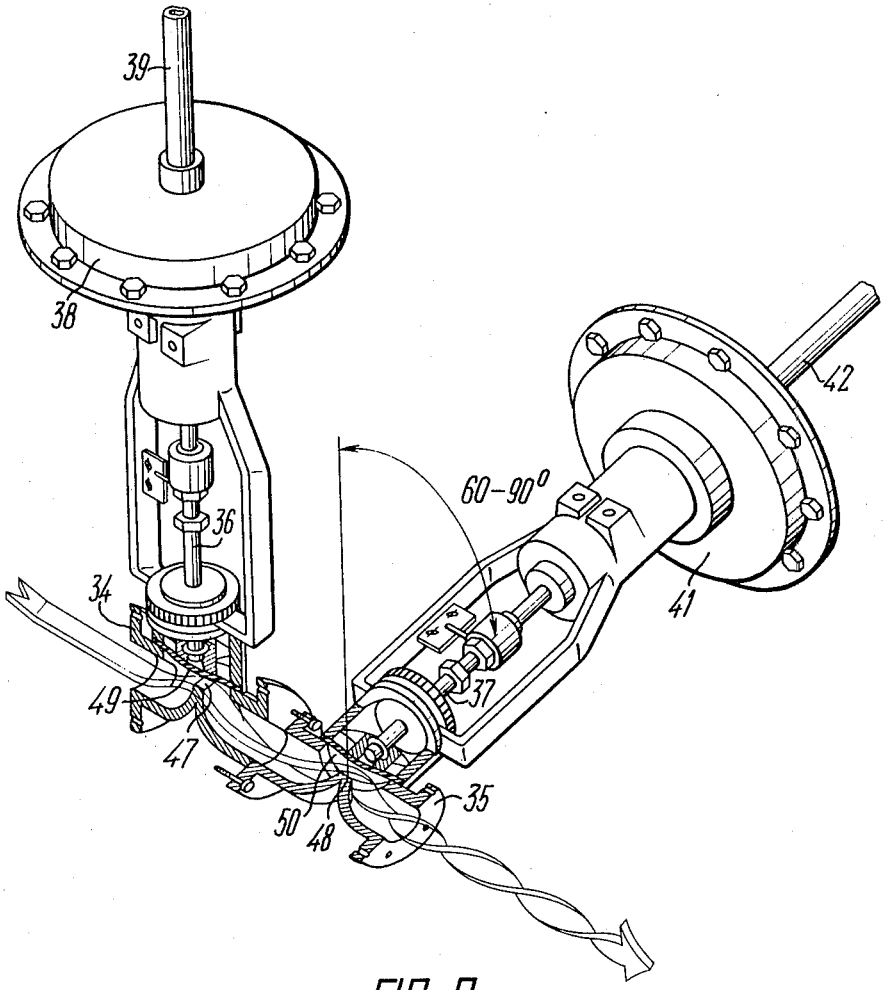
FIG. 2 is a general view of the throttling mixer showing a section through the flow-through passage thereof.

Provided at the outlet of the header 32 are two series-connected normally closed hydraulically operated membrane valves 34 and 35 defining the throttling mixer (FIG. 2), sliding members 36, 37 of the valves 34 and 35 being arranged in two mutually normal planes passing through the axis of the header 32 at an angle of from 60° to 90° thereto.

Figure 3:
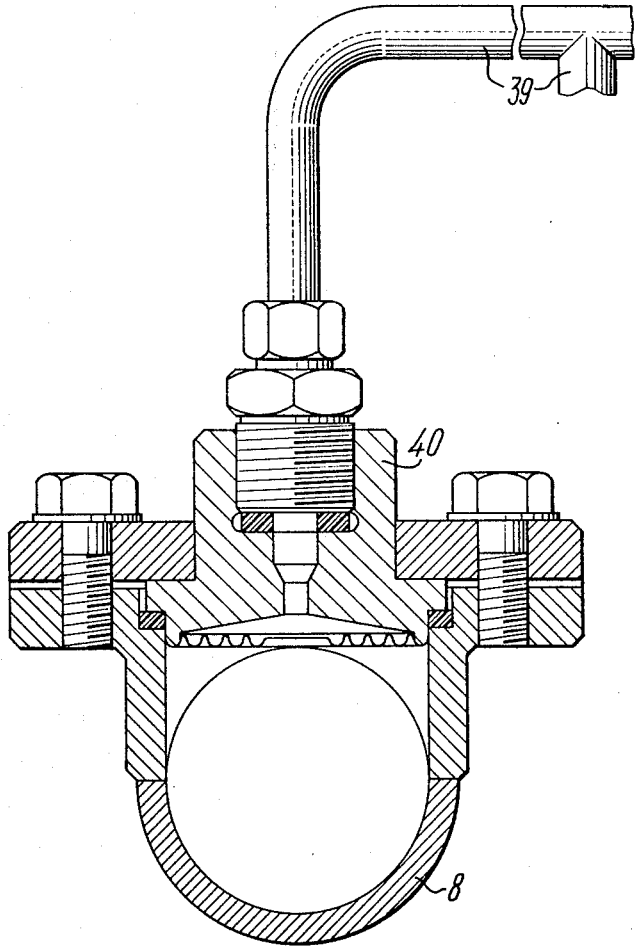
FIG. 3 is a general view of the pressure pickup situated on the suction pipings of the principal components, and on the delivery piping.

A membrane actuator 38 (FIG. 1) of the valve 34 is communicated through a pipe 39 with pressure pickups 40 located on the suction pipings 8, 9, 10, 11, 12, each of said pressure pickups 40 being in effect a membrane splitter (FIG. 3).

A membrane actuator 41 (FIG. 1) of the valve 35 is communicated via a pipe 42 and the pressure pickup 40 with a delivery piping 43 along which the product is passed to a receiving tank 44.

Three-way cocks 45 are provided on the suction pipings 8, 9, 10, 11, 12 to integrate the delivery of the individual pumps of the dispensing unit and aimed at higher production output of the installation when making the products resulting from a lesser number of components (such as alcoholized beverage waters, calvados, etc.).

The installation is operable both manually and automatically.

A required alcohol content is maintained automatically by the comparison method through measuring the electrical conductivity of the components less sugar syrup and the colouring agent which effect the instrument readings, followed by comparing the data of measurements with the electrical conductivity of a reference mixture prepared for the purpose beforehand.

A secondary meter 46 is electrically connected to the alcoholic content pickup 33 and to the electric operator 24 of the pump 19 that feeds softened water. The resultant error signal is used to correct the displacement of the pump 19.

Inasmuch as alcoholized sugar syrup and colouring agent are used under practical production conditions the amount of alcohol brought along with said components is taken into consideration as a correction factor when setting up the installation.

Prior to starting the technological step of blending the original components, the adjusting mechanism of the dispensing pumps through the agency of the actuator 23 and the operator 24 are set to a required hourly rate of feed of each of the components in keeping with the blending flowsheet, while the throttling mixer (i.e., the valves 34 and 35) is set up for a definite pressure differential (such as, say 0.4 MPa). The above-membrane chamber of the actuators 38 and 41, the pipes 39 and 42 and the pressure pickups 40 are filled with a neutral liquid.

The installation for preparing multicomponent mixes in production of strong alcoholic liquors operates as follows.

The blend components taken in a predetermined proportion are fed from the feed tanks 1, 2, 3, 4, 5, 6, 7 in small accurately metered batches to the header 32 at a rate of, say, 1.66 $s^{-1}$ each, after having passed along the pipings 8, 9, 10, 11, 12, 13, 14 by virtue of a negative pressure established by the pumps 15, 16, 17, 18, 19, 20, 21 of the dispensing unit, and through the delivery nozzles 25,26,27,28,29,30,31. While passing through the throttling mixer the flow of the blend components is vigorously intermixed for which part of the flow hydraulic power is spent. The inner projections 47, 48 and diaphragms 49, 50 of the flow-through passage of the valves 34, 35 establish gaps that make up an angle of from 60° to 90° with respect to each other along the throttling mixer axis and adapted to impart stable turbulent motion to the flow of the blend components.

The membrane actuators 38, 41, due to their being communicated with the suction and delivery pipings respectively, through the pressure pickups 40, can vary the clear passage area of said gaps depending upon the maximum pressure effective in suction pipings 8,9,10,11,12 and upon the pressure effective in the delivery piping 43.

Thus, for example, when a maximum static pressure is effective in the suction pipings 8,9,10,11,12 the clear area of the flow passage in the valve 34 is minimized, whereas that of the flow passage in the valve 35 is maximized. As the original components are consumed the pressure effective in the suction pipings 8,9,10,11,12 drops which results in an increased clear area of the flow passage in the valve 34, whereas the static pressure effective in the delivery piping past the throttling mixer will rise, thus diminishing the clear area of the flow passage in the valve 35.

As a result of interaction of the above-listed units and parts identical conditions for intermixing the blend components are provided in the throttling mixer at the beginning of the process when the level of liquids in the feed tanks 1,2,3,4,5 are adequately high, and at the end of the process when the liquid level in the receiving tank 44 reaches a certain height, while that in the feed tanks is lowered.

The blend of the components of strong alcoholic liquors produced with the use of the aforesaid installation needs no further stirring which reduces production costs and amount of lost product.

Given below is an exemplary preparation of a grape (or fruit) brandy with the use of the herein-proposed installation.

The original blend components, e.g., two or three brands of cognac spirit of different ages (three years and older), alcoholized waters featuring the absolute alcohol content within 25 to 30 volume percent, softened water, alcoholized sugar syrup and colouring agent, taken in a predetermined proportion based on a trial blending, are fed from the feed tanks 1 through 7 to the dispensing pump unit.

The nominal delivery rates of the dispensing unit pumps are as follows: 25; 16; 16; 6.3; 1.6; and 1.0 hl/h.

Accurately metered batches of the original components are fed to the header at a rate of, say, 1.66 $s^{-1}$ and a pressure high enough to overcome the hydraulic friction offered by the throttling mixer depending upon its presetting, e.g., 0.4 MPa. Excess hydraulic power of the flow is spent for feeding the resultant blend to further technological operations.

Thus, the above-considered exemplary preparation of a grape (or fruit) brandy in the proposed installation demonstrates that said installation is instrumental in reducing labour consumption for blend preparing, decreasing power consumption more than twice and diminishing the loss of valuable original components by about 0.25 percent.

What is claimed is:

1. An installation for the preparation of multicomponent liquid mixes in the production of alcoholic liquors, comprising:

a plurality of feed tanks adapted to contain respective liquid components;

dispensing pump means including a plurality of dispensing pumps for feeding respective ones of the liquid components;

a plurality of suction pipings, each of said suction pipings communicating between a respective feed tank and a respective one of said dispensing pumps;

header means for collecting said liquid components;

a plurality of delivery pipings, each of said delivery pipings communicating between a respective dispensing pump and said header means;

a receiving tank adapted to receive the mixed liquid components;

a throttling mixer including normally closed hydraulically operated membrane valves arranged substantially at the outlet of said header means, each of said membrane valves being provided with a respective membrane actuator having an above-membrane chamber;

a common delivery pipe communicating between the outlet of said throttling mixer and said receiving tank;

pressure pickups installed on at least some of said suction pipings and on said common delivery pipe and an alcohol content pickup installed on said header means; and means communicating said above-membrane chambers of said membrane actuators with said suction pipings and common delivery pipe, respectively.

2. An installation as claimed in claim 1, wherein the membrane valves are arranged in series, and wherein said membrane actuators include respective sliding elements, said sliding elements of the membrane actuators being arranged in two mutually substantially normal planes passing through the header axis at an angle of from about 60° to about 90° thereto.

3. An installation as claimed in claim 1, wherein the above-membrane chamber of one of said membrane actuators communicates with said pressure pickups in the suction pipings, and wherein the above-membrane chamber of another membrane actuator communicates with the pressure pickup in the common delivery pipe.

4. An installation as claimed in claim 1, wherein said header includes an inlet for sugar syrup and an inlet for colour agent and wherein the alcohol content pickup is situated on the header before the inlets for sugar syrup and colour agent.

* * * * *